US009476264B2

(12) United States Patent
Plain

(10) Patent No.: US 9,476,264 B2
(45) Date of Patent: Oct. 25, 2016

(54) COILED TUBING LIFT FRAME ASSEMBLY AND METHOD OF USE THEREOF

(71) Applicant: Icon Engineering Pty Ltd

(72) Inventor: Steven Plain, Burswood (AU)

(73) Assignee: ICON ENGINEERING PTY LTD, West Perth, Western Australia (AU)

( * ) Notice: Subject to any disclaimer, the term of this patent is extended or adjusted under 35 U.S.C. 154(b) by 0 days.

(21) Appl. No.: 14/520,639

(22) Filed: Oct. 22, 2014

(65) Prior Publication Data

US 2016/0060977 A1 Mar. 3, 2016

(30) Foreign Application Priority Data

Sep. 2, 2014 (AU) ..... 2014221196

(51) Int. Cl.

| | |
|---|---|
| ***E21B 29/12*** | (2006.01) |
| ***E21B 17/00*** | (2006.01) |
| ***E21B 19/00*** | (2006.01) |
| ***E21B 17/20*** | (2006.01) |
| ***E21B 43/01*** | (2006.01) |
| ***E21B 19/09*** | (2006.01) |

(52) U.S. Cl.

CPC ..... *E21B 19/006* (2013.01); *E21B 17/20* (2013.01); *E21B 19/09* (2013.01); *E21B 43/0107* (2013.01)

(58) Field of Classification Search

None

See application file for complete search history.

(56) References Cited

U.S. PATENT DOCUMENTS

| | | | |
|---|---|---|---|
| 3,718,316 | A | 2/1973 | Larralde |
| 3,785,445 | A | 1/1974 | Scozzafava |
| 3,839,976 | A | 10/1974 | Swenson et al. |
| 3,871,622 | A | 3/1975 | Larralde |
| 3,902,319 | A | 9/1975 | Olmsted |
| 3,912,227 | A | 10/1975 | Meeker |
| 4,759,256 | A | 7/1988 | Kovit |
| 5,846,028 | A | 12/1998 | Thory |

(Continued)

FOREIGN PATENT DOCUMENTS

| | | |
|---|---|---|
| EP | 0 207 915 | 1/1987 |
| GB | 2515391 | 12/2014 |

(Continued)

OTHER PUBLICATIONS

UK Intellectual Property Office Combined Search and Exam Report for Application No. GB1407907.3 dated Oct. 14, 2014 (5 pages).

(Continued)

*Primary Examiner* — Matthew R Buck
*Assistant Examiner* — Douglas S Wood
(74) *Attorney, Agent, or Firm* — Brinks Gilson & Lione; G. Peter Nichols

(57) ABSTRACT

A coiled tubing lift frame assembly for use as a back-up heave compensator on a floating vessel is described. The assembly includes a frame having an upper frame section adapted for attachment to a top drive system and a lower frame section adapted to interface with a flowhead assembly. The assembly also includes a pair of hydraulic cylinders spaced apart from one another, the hydraulic cylinders having a respective cylinder barrel and a piston rod translatable therein with free end of the piston rods being fixed to the upper frame section. The assembly also includes a piston accumulator disposed adjacent to a first of the hydraulic cylinders and in fluid communication therewith via a hydraulic fluid line and an air accumulator disposed adjacent to a second of the hydraulic cylinders and in fluid communication with the piston accumulator via a pneumatic fluid line.

22 Claims, 13 Drawing Sheets

(56) References Cited

U.S. PATENT DOCUMENTS

| | | | | |
|---|---|---|---|---|
| 7,231,981 | B2 | 6/2007 | Moe | |
| 7,329,070 | B1 | 2/2008 | Trent | |
| 7,934,561 | B2 * | 5/2011 | Ormond | E21B 19/006 114/264 |
| 8,157,013 | B1 | 4/2012 | Trent | |
| 8,162,062 | B1 | 4/2012 | Barone et al. | |
| 8,590,626 | B2 * | 11/2013 | Barone | E21B 19/006 166/345 |
| 2004/0099421 | A1 | 5/2004 | Trewhella | |
| 2004/0108117 | A1 | 6/2004 | Williams | |
| 2005/0077049 | A1 | 4/2005 | Moe | |
| 2012/0267117 | A1 | 10/2012 | Skinnes | |
| 2014/0034329 | A1 * | 2/2014 | Skinnes | E21B 19/006 166/355 |
| 2014/0331908 | A1 * | 11/2014 | Plain | 114/122 |
| 2015/0184470 | A1 | 7/2015 | Megens | |

FOREIGN PATENT DOCUMENTS

| | | |
|---|---|---|
| WO | WO 2007/139394 | 12/2007 |
| WO | WO 2011/074984 | 6/2011 |
| WO | WO 2012/148289 | 11/2012 |
| WO | WO 2013/137743 | 9/2013 |

OTHER PUBLICATIONS

UK Intellectual Property Office Combined Search and Exam Report for Application No. GB1418790.0 dated Feb. 27, 2015 (8 pages).
U.S. Appl. No. 13/892,020 Non-Final Office Action dated Aug. 18, 2015 (17 pages).
AU Application No. 2013205798 Patent Examination Report 1 dated Sep. 18, 2015 (3 pages).
Australian patent application No. 2014221196 Patent Examination Report No. 1 dated Jan. 20, 2016 (5 pages).

* cited by examiner

COILED TUBING LIFT FRAME ASSEMBLY AND METHOD OF USE THEREOF

This application claims priority to Australian patent application No. 2014221196 filed on Sep. 2, 2014, the entire contents of which is incorporated herein by reference.

BACKGROUND

A coiled tubing lift frame assembly for use on floating drilling vessels such as drilling ships and semi-submersible drilling vessels. In particular the coiled tubing lift frame assembly is configured with integrated over and under tension protection and back up heave compensation.

As oil and gas offshore exploration and production operations are increasingly established in deeper waters, it has become more common for drilling activities to be performed from rigs that float on the surface of the water, such as drilling vessels or semi-submersible drilling rigs. Unlike fixed rigs or jack-up rigs, floating rigs are subject to wave motion, causing up- and down motion, which must be compensated for during drill, well completions, well testing, well interventions and other operations. Wave motion is of particular concern during "locked-to-bottom" operations (i.e. well completion, well testing and well intervention) where a completions workover riser or landing string (alternatively referred to as a 'riser') is physically connected to the subsea well at the seabed. It will be appreciated that, depending on the nature of the operations, the riser may be connected to the well-head, to a subsea tree or other infrastructure at the top of the well. Loss of heave compensation can lead to severe consequences.

Apart from the operational difficulties arising from the up-and-down motion of the floating rig, significant safety issues also arise, in particular the potential for the riser to fracture or buckle, resulting in loss of well containment and blowout. Indeed, safety standards in offshore operations demand that a heave compensation system be regarded as an essential component of a floating rig during locked-to-bottom operations.

Known heave compensation systems may be described as employing passive heave compensation or active heave compensation.

A simple passive heave compensator is a soft spring which effectively strokes in and out in response to riser loads as the vessel heaves up and down while effectively holding constant tension on the riser. Exemplary types of simple passive heave compensators are crown-mounted compensators or inline passive drill string compensators. Passive heave compensators employ hydraulic cylinders and associated gas accumulators to store and dissipate the energy as the vessel heaves up and down.

Active heave compensation differs from passive heave compensation by having an external control system with external inputs from motion reference units that actively tries to compensate for any movement at a specific point. Exemplary types of active heave compensation include active heave draw works which employ electric or hydraulic winch systems to raise and lower the top drive in response to the vessel motion.

Active-passive compensation systems consist of a primary passive compensation system with secondary actively driven hydraulic cylinders to reduce tension variations and improve efficiency. Two independent active and passive systems are generally not employed.

The essential nature of the heave compensation function to a floating rig is such that safety standards also demand that they be designed such that no single component failure shall lead to overall failure of the system. They should also be "fail to safety" meaning that in the event of any predictable failures, the system defaults to a compensating state, which is the safest state during locked-to-bottom operations. While active heave draw works have numerous benefits for normal drilling operations, they fail to a "locked condition", which is undesirable for well completions, well testing and well intervention operations. Passive compensation systems (e.g. crown mounted compensators) are also not immune to failures. Safe operations and industry standards require additional means of safety to be implemented in the system/equipment configuration. Additional means of safety may include an in-line tensioner or traditional coiled tubing lift frame, design of a weak link in the riser/landing string, weaklink bails, limiting operation parameters to be within the stretch limit of the riser, and so forth.

Generally, these operating parameters place constraints on operators which have direct impact on productivity and efficiency. All these existing options have limitations. In the case of a standard inline tensioner or traditional coiled tubing lift frame, there are concerns about the how the system behaves when run in series with the active heave draw works. In the case of the weak link in the riser and weaklink bails, they typically only provide protection in an over-tensioned case and once broken, they provide no support to the landing string thereafter. In the case of limiting operating parameters to within the stretch of the riser, this can impose considerable downtime during offshore operations.

It would be advantageous to provide an inline tensioner or back-up compensator which can be fully locked under normal operating loads so that it did not interfere with the operations of the primary compensator, but which is capable of automatic and rapid activation to provide compensation if axial load on the riser exceeds normal operation limits, which may occur in event of failure of the rig's primary compensator.

There is therefore a need for an alternative or improved heave compensation apparatus which may operate as a back-up to the rig's drill string compensator in the event of failure or disablement of the rig's drill string compensator.

There is also a need for an improved heave compensation apparatus which can be used as a lift frame for the installation of intervention pressure control equipment (i.e. coiled tubing or wireline equipment) during well testing/well intervention work, as those components are installed in the congested space of the drilling derrick.

The above references to background art do not constitute an admission that the art forms a part of the common general knowledge of a person of ordinary skill in the art. The above references are also not intended to limit the application of the heave compensation and tensioning apparatus as disclosed herein.

SUMMARY

Generally, a coiled tubing lift frame assembly and a method of use thereof, are disclosed. The coiled tubing lift frame assembly may be employed as a back-up to a floating vessel's primary compensator in the event of failure or disablement of the rig's primary compensator. The primary compensator may be in the form of a crown mounted compensator, active heave drawworks, or other type of drill string compensator.

According to a first aspect, there is disclosed a coiled tubing lift frame assembly, said assembly comprising:

a frame having an upper frame section adapted for attachment to a top drive system and a lower frame section adapted to interface with a flowhead assembly;

a pair of hydraulic cylinders spaced apart from one another, the hydraulic cylinders having a respective cylinder barrel and a piston rod translatable therein, a free end of the piston rods being fixed to the upper frame section;

a piston accumulator disposed adjacent to a first of the hydraulic cylinders and in fluid communication therewith via a hydraulic fluid line;

an air accumulator disposed adjacent to a second of the hydraulic cylinders and in fluid communication with the piston accumulator via a pneumatic fluid line;

wherein the piston rods in said cylinders remain stationary at a mid-stroke position when an axial load on the riser is within a predetermined range of operating loads, said piston rods extending on an upheave of the floating vessel when the axial load exceeds a predetermined upper operating load threshold and retracting on a down heave of the floating vessel when the axial load falls below a predetermined lower operating load threshold.

The air accumulator may be in the form of an air pressure vessel.

In one embodiment the air accumulator and the piston accumulator are respectively longitudinally aligned with the first and the second of the hydraulic cylinders. In this arrangement, respective lower ends of the air accumulator and the piston accumulators are fixed to the lower frame section, thereby providing a rigid link to said frame assembly.

In another embodiment the air accumulator and the piston accumulator are respectively laterally aligned with the first and the second of the hydraulic cylinders. In this arrangement respective lower ends of the hydraulic cylinders are coupled to the lower frame section with coupling elements, thereby providing a flexible link to said frame assembly.

The upper frame section may be attached to the top drive system by means of coupling elements, such as elevator links or bails.

In one embodiment, the hydraulic cylinders are arranged to be in fluid communication with one another via the hydraulic line, whereby the hydraulic pressure in each cylinder is the same. The provision of the same hydraulic pressure in each cylinder ensures that the respective piston rods extend or retract simultaneously in response to the axial load on the riser.

The coiled tubing lift frame assembly may further comprise a control valve assembly arranged to control fluid flow through the hydraulic fluid line and thereby allow the piston rods to retract or extend in response to, and to compensate for, heave of the floating vessel. The control valve assembly may comprise an overpressure valve in the hydraulic line and an under pressure valve to redirect fluid flow through a bypass line configured to bypass the over pressure valve. The overpressure valves and the under pressure valves are configured to remain closed when the axial load on the riser is within the predetermined range of operating loads, thereby causing the piston rods in said cylinders to remain stationary at a mid-stroke position.

When the primary compensator fails and the axial load exceeds a predetermined upper operating load threshold, the overpressure valve opens to allow hydraulic fluid to flow through the hydraulic line between the cylinders and the piston accumulator, thereby allowing the piston rods in the cylinders to extend. Alternatively, when the axial load falls below a predetermined lower operating threshold, the under pressure valve opens to redirect hydraulic fluid through the bypass line and flow between the cylinders and the piston accumulator, thereby allowing the piston rods in the cylinders to retract.

In one embodiment the piston accumulator comprises a cylinder barrel having a hydraulic chamber and a pneumatic chamber defined therein, wherein the pneumatic chamber is in communication with the air accumulator via the pneumatic fluid line and the hydraulic chamber is in communication with the first of the cylinders via the hydraulic fluid line.

In another embodiment, each piston rod is hollow and in fluid communication with a respective blind side of each respective cylinder via an aperture in the piston head, the hollow piston rod thereby defining a low pressure air accumulator therein.

The disclosure also describes a method for providing back up compensation for a riser used in operations on a floating vessel in the event of failure of a primary compensator, the method comprising:

providing the coiled tubing lift frame assembly as defined above;

locating the frame between the top drive system and the flow head assembly in a manner whereby the upper frame section of the frame is coupled to the top drive system and the lower frame section of the frame is coupled to the flow head assembly;

disposing the piston rods in the hydraulic cylinders in a back-up mode whereby the piston rods remain stationary at a mid-stroke position when an axial load on the risers is within a predetermined range of operating loads; and, in the event of failure of the primary compensator and the axial load on the riser exceeding a predetermined upper operating load threshold or falling below a predetermined lower operating load threshold, allowing the piston rods to extend or retract from the mid-stroke position, respectively.

In some embodiments, in the event of failure of the primary compensator and the axial load on the riser exceeding a predetermined upper operating load threshold or falling below a predetermined lower operating load threshold, the method further comprises automatically actuating the over pressure valve or under pressure valve of the control assembly, respectively.

In the event of actuation of the over pressure valve, the overpressure valve latches open and provides an unrestricted flow path between the cylinders and the piston accumulator allowing the system to provide back-up compensation. Back-up compensation may be provided in a form of a passive compensator.

It will also be appreciated that the method may comprise the step of manually opening the over pressure valve to purposefully actuate the coiled tubing lift frame assembly to provide passive heave compensation.

BRIEF DESCRIPTION OF THE DRAWINGS

Notwithstanding any other forms which may fall within the scope of the riser tension protector and coiled tubing frame assembly as set forth in the Summary, specific embodiments will now be described, by way of example only, with reference to the accompanying drawings in which.

DETAILED DESCRIPTION

Embodiments of a coiled tubing lift frame assembly for use as a back-up compensator for a riser used in operations on a floating vessel will now be described by way of example only, and with particular (though not exclusive) reference to drilling and completions for oil and gas reserves offshore.

Figure 1:
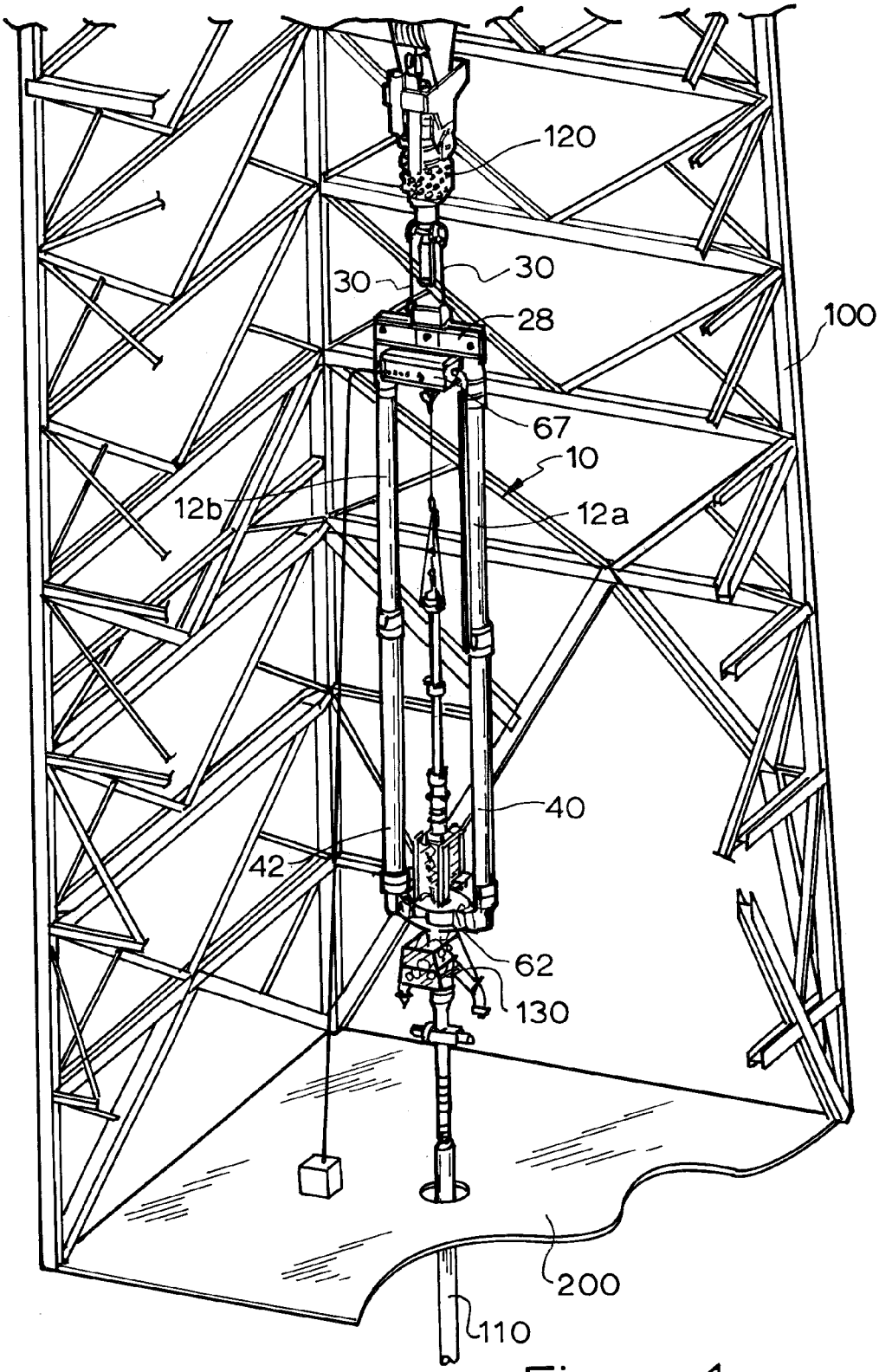
FIG. 1 is a partial schematic representation of a derrick and drill floor of a floating vessel showing a coiled tubing lift frame assembly in accordance with one embodiment configured in-line with various components used in locked-to-bottom operations for oil and gas reserves offshore.
Figure 2:
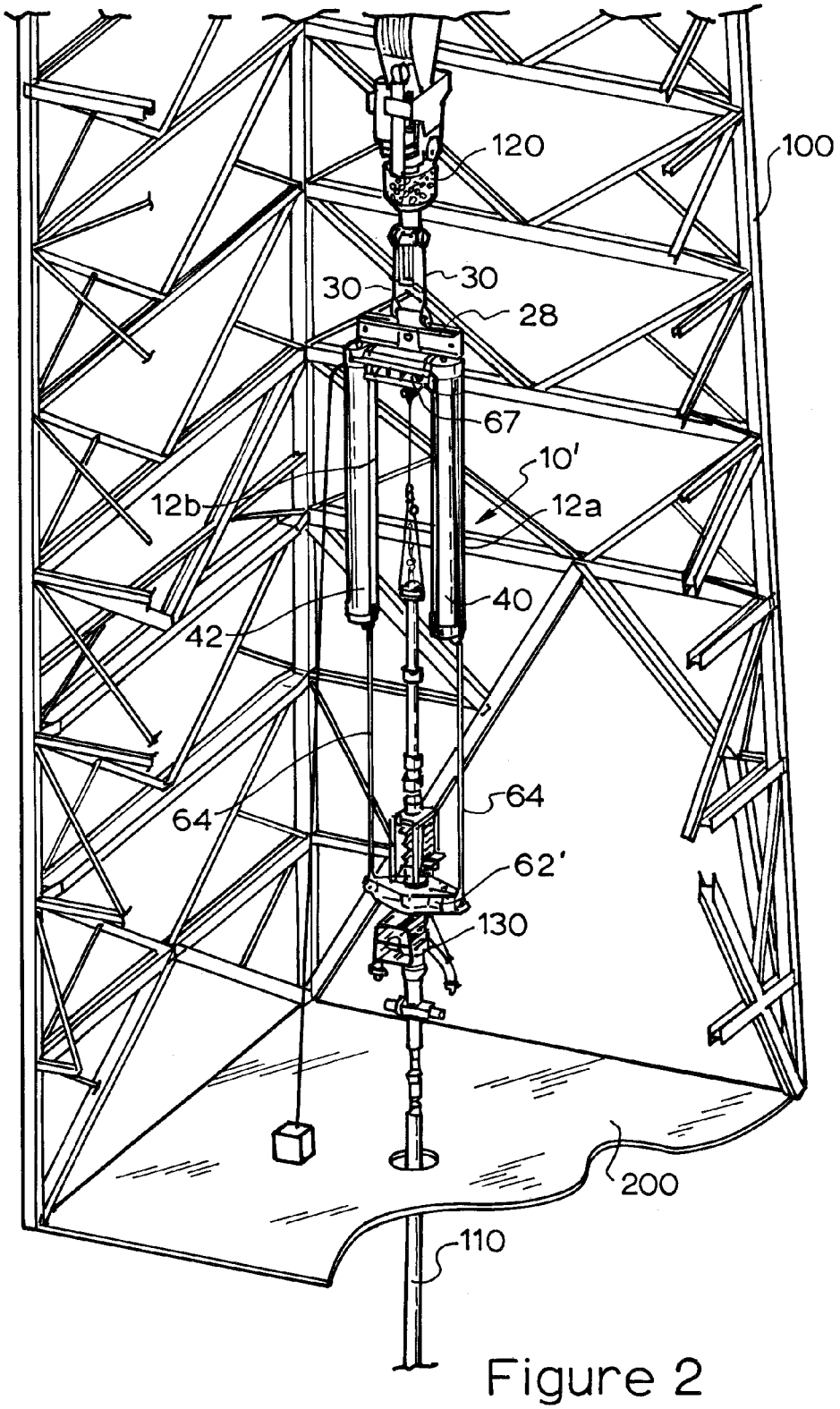
FIG. 2 is a partial schematic representation of a derrick and drill floor of a floating vessel showing a coiled tubing lift frame assembly in accordance with an alternative embodiment configured in-line with various components used in locked-to-bottom operations for oil and gas reserves offshore.
Figure 3:
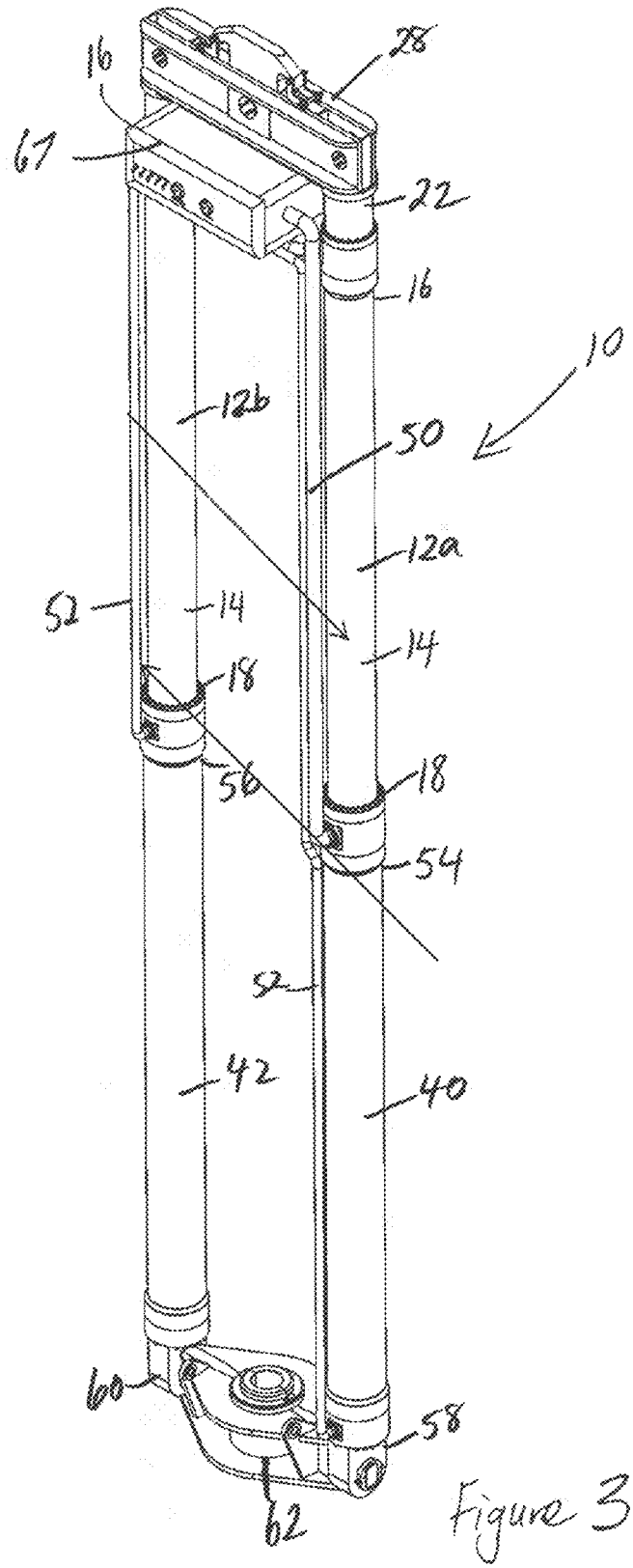
FIG. 3 is a schematic representation of the coiled tubing lift frame assembly shown in FIG. 1, wherein the piston rods are shown fully retracted.

Referring to FIGS. 1 and 2, where like numerals refer to like parts throughout, there is shown a partial and schematic view of a derrick 100 and a drill floor 200 of a floating vessel used in locked-to-bottom operations for oil and gas operations offshore. The derrick 100 extends upwardly above the drill floor 200 and supports the main hoisting and drilling components used in drilling operations.

The derrick 100 may support a hoisting assembly, such as a block and tackle, for raising and lowering a completions/workover riser or landing string 110 (alternatively referred to as a 'riser') which may be configured to pass through the drill floor 200 and facilitate well completions/well testing/well intervention of a subsea production well. A lower end of the riser 110 may be fixed to the wellhead at the seafloor by means of a tubing hanger within a subsea tree or connected to other subsea infrastructure in what may be termed locked-to-bottom' operations. The upper end of the riser may be fixed to a flowhead assembly 130 above the drill floor 200. A top drive system 120 may be provided to also facilitate lowering or lifting of the riser 110.

The hoisting assembly may be provided with a primary heave compensator. The primary heave compensator may be an active heave drawworks system or a passive heave compensator mounted on the top of the derrick 100. As discussed above, if this primary heave compensator fails or becomes inoperative, the fluctuation in the vertical position of the floating vessel relative to the seafloor due to wave motion will place the riser 110 under alternating compression and tension.

The coiled tubing lift frame assembly 10,10', in the embodiments described herein, provides a back-up or secondary heave compensator which is configured to compensate for excessive axial load on the riser 110 in an up heave or a down heave of the floating vessel when the primary heave compensator fails. This particular embodiment provides 'over tension protection' and 'under tension protection'.

The coiled tubing lift frame assembly 10, 10' may be configured in-line below the rig's primary heave compensation system. The coiled tubing lift frame assembly 10, 10' may be operatively associated at one end thereof with the top drive system 120 and fixed relative to the flowhead assembly 130. Installed in this way, the coiled tubing lift frame assembly 10, 10' may be suspended above the drill floor 200 of the floating vessel.

In normal inline operation, the coiled tubing lift frame assembly 10, 10' may be disposed in a fixed length mode whereby respective piston rods of a pair of hydraulic cylinders remain stationary and at mid-stroke in respective cylinder barrels. The primary heave compensator accounts for the heave of the floating vessel but, in the event of failure of the primary heave compensator, the piston rods of the hydraulic cylinders may automatically extend to prevent excessive axial load on the riser 110 in response to an upheave of the vessel. Alternatively, the piston rods may automatically retract further within the cylinder barrels in response to a down heave of the vessel.

Referring generally to FIGS. 3 to 13, where like reference numerals refer to like parts throughout, there are shown embodiments of the coiled tubing lift frame assembly 10, 10' as described herein.

Figure 4:
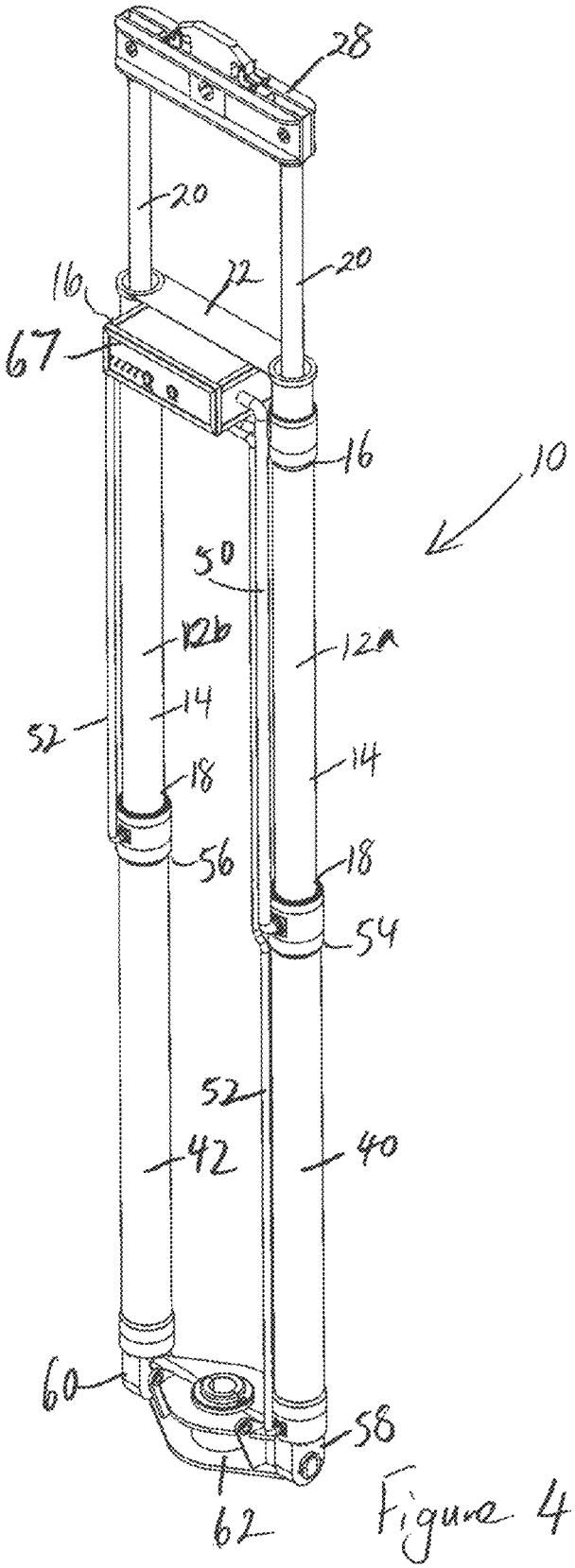
FIG. 4 is a schematic representation of the coiled tubing lift frame assembly shown in FIG. 3, wherein the piston rods are shown in mid-stroke position.
Figure 5:
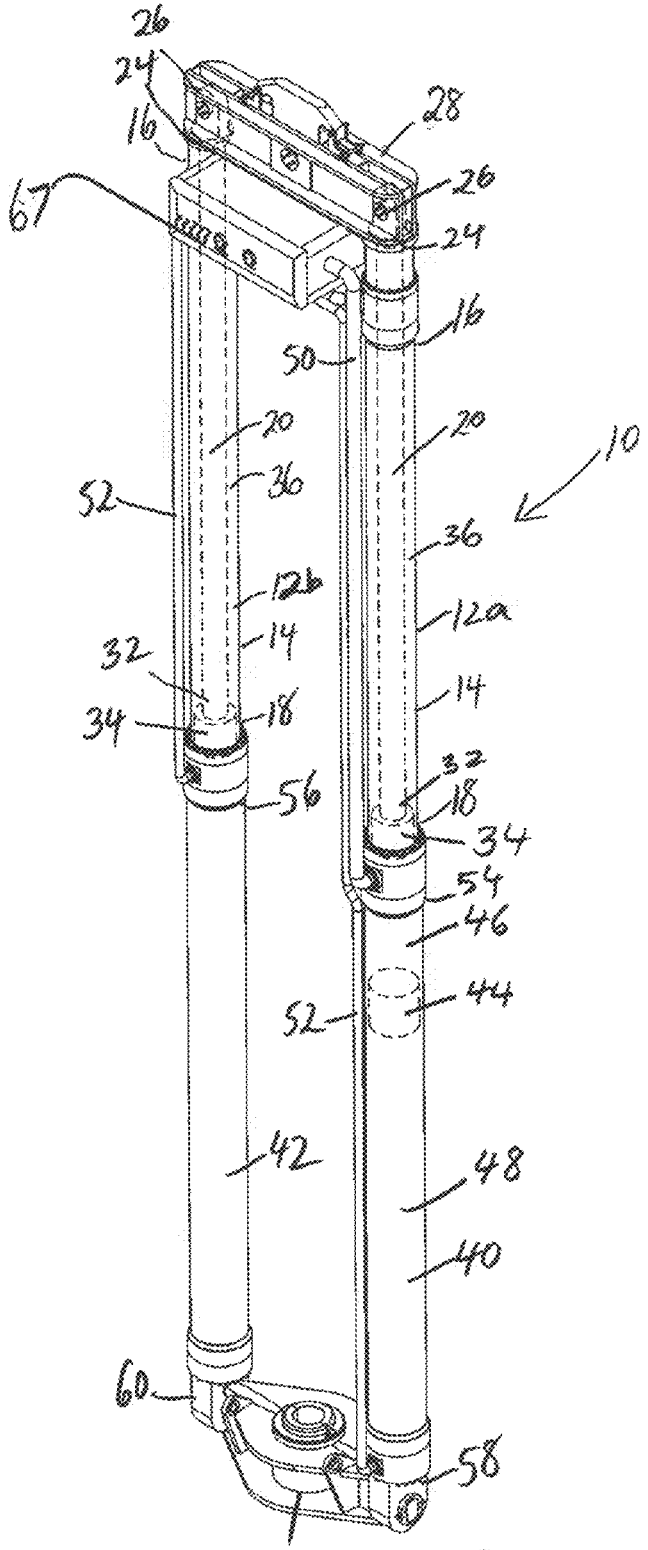
FIG. 5 is a schematic representation of the coiled tubing lift frame assembly shown in FIG. 3 with piston rods and floating piston shown in phantom.
Figure 6:
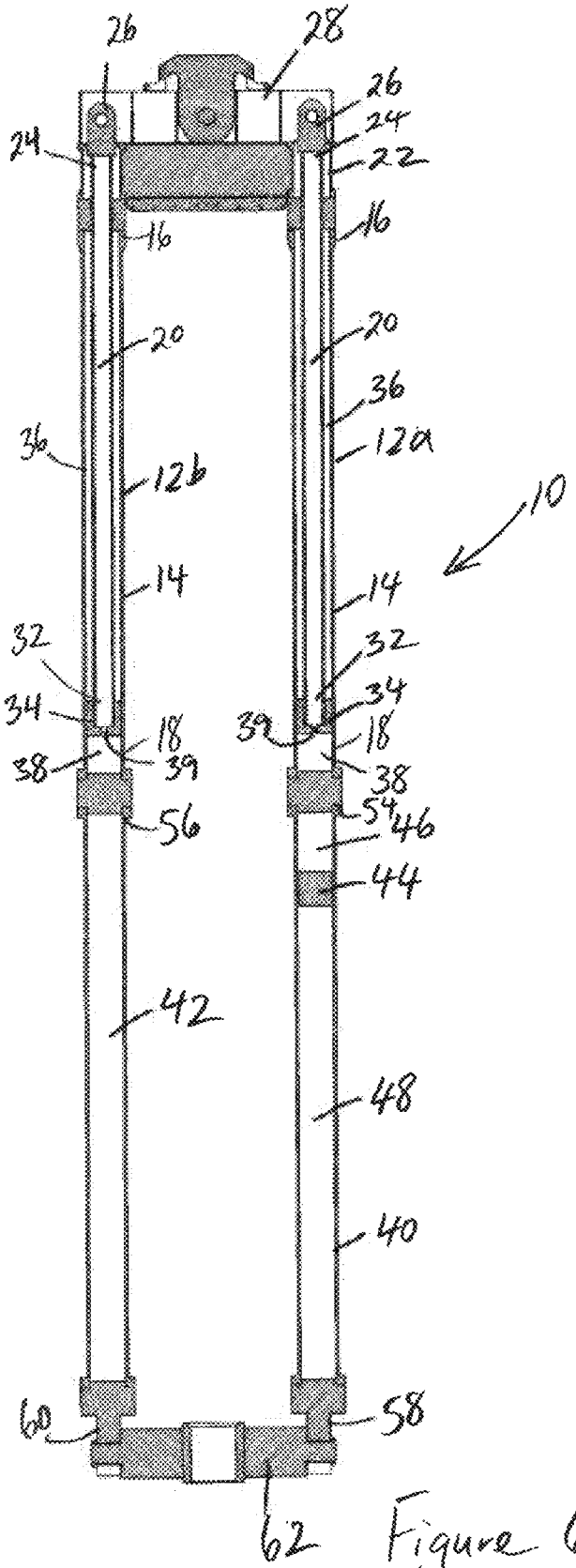
FIG. 6 is a longitudinal cross-sectional representation of the coiled tubing lift frame assembly shown in FIG. 3.

The coiled tubing lift frame assembly 10, 10' includes a pair of hydraulic cylinders 12*a*, 12*b* spaced apart from one another. Each hydraulic cylinder 12*a*, 12*b* has a cylinder barrel 14 having an upper end 16 and a lower end 18, and a piston rod 20 translatable within the cylinder barrel 14 between a retracted mode and an extended mode. In some embodiments, the piston rod 20 may have a stroke of up to 6 m or greater, the fully extended mode being defined by a physical end stop of the cylinder barrel 14. Under normal operating conditions, whereby the primary heave compensator is operable, the piston rods 20 may remain stationary in the cylinder barrel 14, in a mid-stroke mode, as shown in FIG. 4. In the event of failure of the primary heave compensator and in response to a load on the riser 110 in excess of a predetermined axial load, however, the piston rods 20 may extend or retract to prevent excessive tension on the riser 110 on an upheave or a down heave of the vessel.

The upper ends 16 of the cylinder barrels 14 are interconnected by a cross member 22, as will be described in more detail with reference to FIG. 10. The cross member 22 provides rigid structural support for the pair of hydraulic cylinders 12.

The piston rod 20 has a free end 24 with a clevis 26 associated therewith. In use, the clevis 26 of each piston rod 20 is operatively associated with an upper frame section 28, as will be described in more detail with reference to FIG. 9.

The upper frame section 28 may be adapted for attachment to the top drive system 120 via coupling elements 30, such as elevator links.

An opposing end 32 of the piston rod 20 is associated with a piston head 34. The piston head 34 is translatable within the cylinder barrel 14, thereby defining a hydraulic chamber 36 that is filled with hydraulic fluid and a 'blind' chamber 38 that is filed with air or nitrogen. The 'blind' chamber 38 is commonly referred to as the blind side of the cylinder 12.

The piston rod 20 may be hollow and in fluid communication with the blind chamber 38 of the cylinder 12 via an aperture 39 in the piston head 34. In this configuration, the hollow piston rod 20 may define a low pressure air accumulator therein to accommodate fluctuation in gas pressure in the blind chamber 38 of the cylinder 12 when the piston rod 20 retracts or extends in response to, and to compensate for, heave of the floating vessel.

The coiled tubing lifting assembly 10, 10' also includes a piston accumulator 40 disposed adjacent to a first of the hydraulic cylinders 12*a* and an air accumulator 42 disposed adjacent to a second of the hydraulic cylinders 12*b*.

The piston accumulator 40 has a floating piston 44 which defines a hydraulic chamber 46 and a pneumatic chamber 48 within the piston accumulator 40. Generally, the piston accumulator 40 will be a fluid-over-air accumulator. The hydraulic chamber 46 of the piston accumulator 40 is filled with hydraulic fluid and is in operative communication with the hydraulic chambers 36 of the cylinders 12*a*, 12*b* via a hydraulic fluid line 50. It will be appreciated that the piston accumulator 40 will be appropriately sized to have a holding capacity sufficient to accommodate substantially all of the hydraulic fluid from the hydraulic cylinders 12 when the piston rods 20 are fully extended.

In contrast to prior art coiled tubing lift frames which associate a piston accumulator with each hydraulic cylinder, the embodiments described herein only includes a single piston accumulator. The inventor has observed that when more than one floating piston accumulator are used, the floating pistons of the dual piston accumulators do not necessarily synchronise and additional control mechanisms have to be incorporated into the prior art coiled tubing lift frame to counteract this problem. By employing only a single piston accumulator in the embodiments described herein, the problem of asymmetric floating pistons becomes no longer relevant.

The pneumatic chamber 48 of the piston accumulator 40 is in fluid communication with the air accumulator 42 via a pneumatic fluid line 52. The air accumulator 42 and the pneumatic chamber 48 behave as a high pressure air accumulator and typically have a pressure in a range of 150 bar to 207 bar, even greater. Incorporation of the high pressure air accumulator 42 and piston accumulator 40 in the frame assembly 10 eliminates the need for additional air pressure vessels on the deck, eliminates flexible connecting pneumatic hoses in the derrick 100 and the safety hazards associated therewith, and also saves deck space and set-up time. The air accumulator 42 may be provided with a pressure relief valve 53 which is set at a maximum allowable working pressure.

In one embodiment of the coiled tubing lift frame assembly 10, as shown in FIGS. 1, 3-6 and 13, the piston accumulator 40 is longitudinally aligned with the first of the hydraulic cylinders 12*a* and the air accumulator 42 is longitudinally aligned with the second of the hydraulic cylinders 12*b*. In this particular embodiment, the lower ends 18 of the cylinder barrels 14 are coaxially fixed to respective upper ends 54, 56 of the piston accumulator 40 and the air accumulator 42. Respective lower ends 58, 60 of the piston accumulator 40 and the air accumulator 42 are fixed to a lower frame section 62 of the coiled tubing lift frame assembly 10, as will be described later in more detail with reference to FIG. 11. It will be appreciated that the piston accumulator 40 and the air accumulator 42 are substantially of similar length.

Advantageously, the longitudinal alignment of the piston accumulator 40 and the air accumulator 42 with respective hydraulic cylinders 12 imparts rigidity to the coiled tubing lift frame assembly 10, thereby providing a fully fixed and rigid work window for rigging up intervention/pressure control equipment. This particular configuration also allows for additional auxiliary structures to be fitted to the coiled tubing lift frame such as a coiled tubing injector head jacking table, a wireline manipulator arm, access platforms and so forth.

Figure 7:
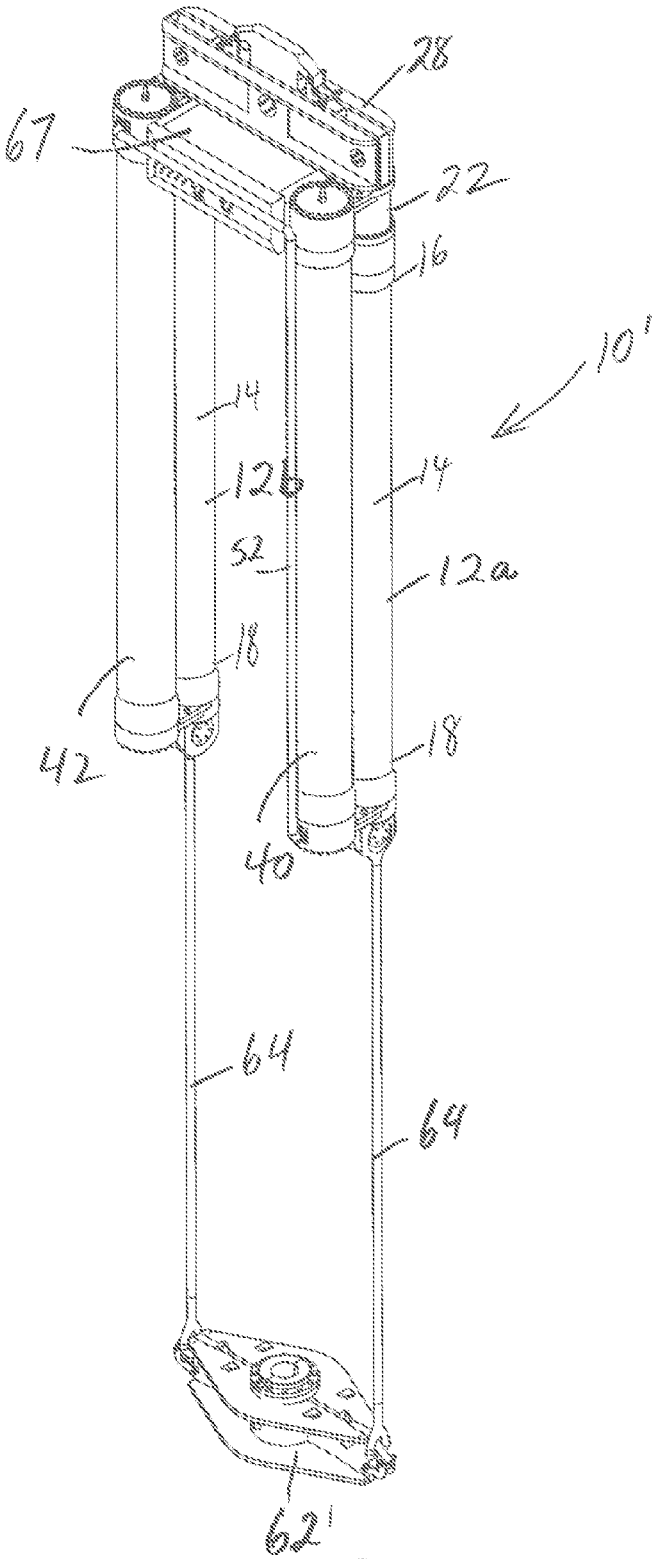
FIG. 7 is a schematic representation of the coiled tubing lift frame assembly shown in FIG. 2, wherein the piston rods are shown fully retracted.
Figure 8:
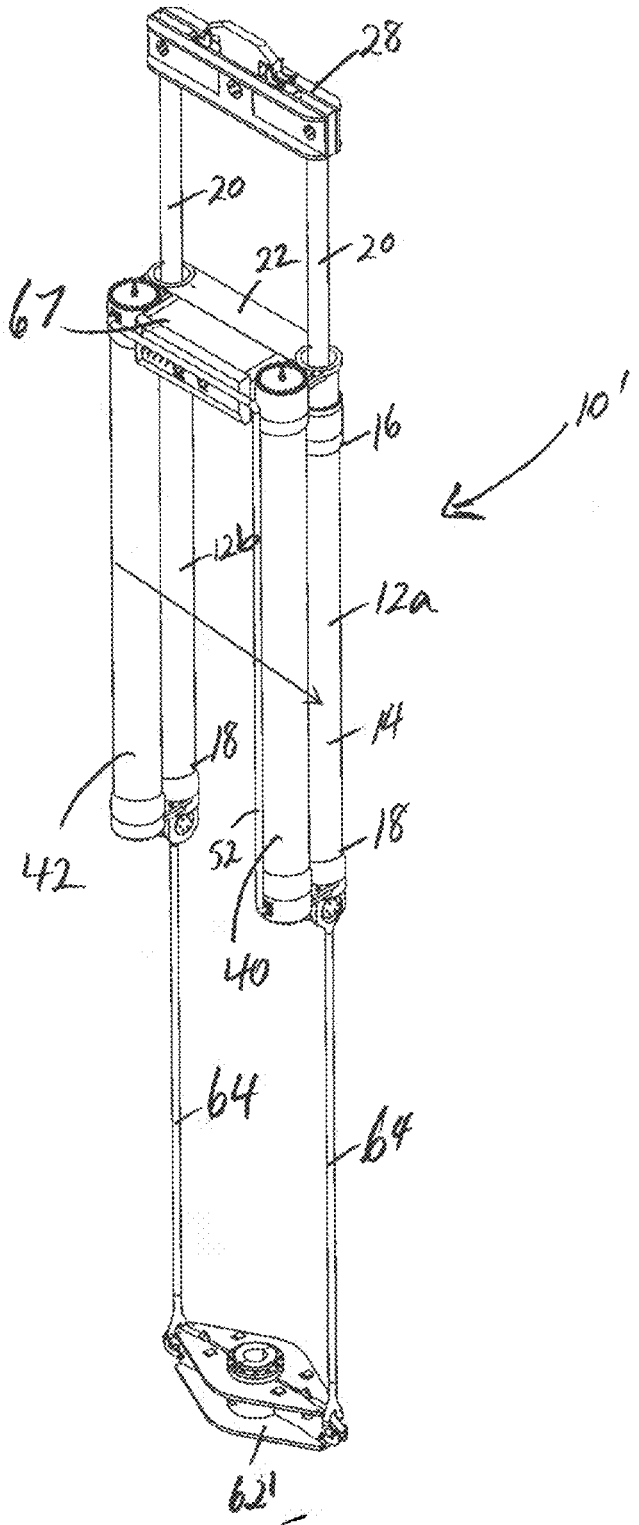
FIG. 8 is a schematic representation of the coiled tubing lift frame assembly shown in FIG. 7, wherein the piston rods are shown in mid-stroke position.

In an alternative embodiment of the coiled tubing lift frame assembly 10', as shown in FIGS. 2, 7-8, the piston accumulator 40 and the air accumulator 42 are respectively laterally aligned with the first and the second of the hydraulic cylinders 12*a*, 12*b*. In this arrangement respective lower ends 18 of the cylinder barrels 14 are coupled to the lower frame section 62' of the coiled tubing lift frame assembly 10', as will be described later in more detail with reference to FIG. 12. The cylinder barrels 14 may be coupled to the lower frame section 62' by coupling elements 64, such as elevator links or long bails. In this particular embodiment, the longitudinal alignment of the coupling elements 64 with respective hydraulic cylinders 12 imparts a certain degree of flexibility to the coiled tubing lift frame assembly 10'

Figure 9:
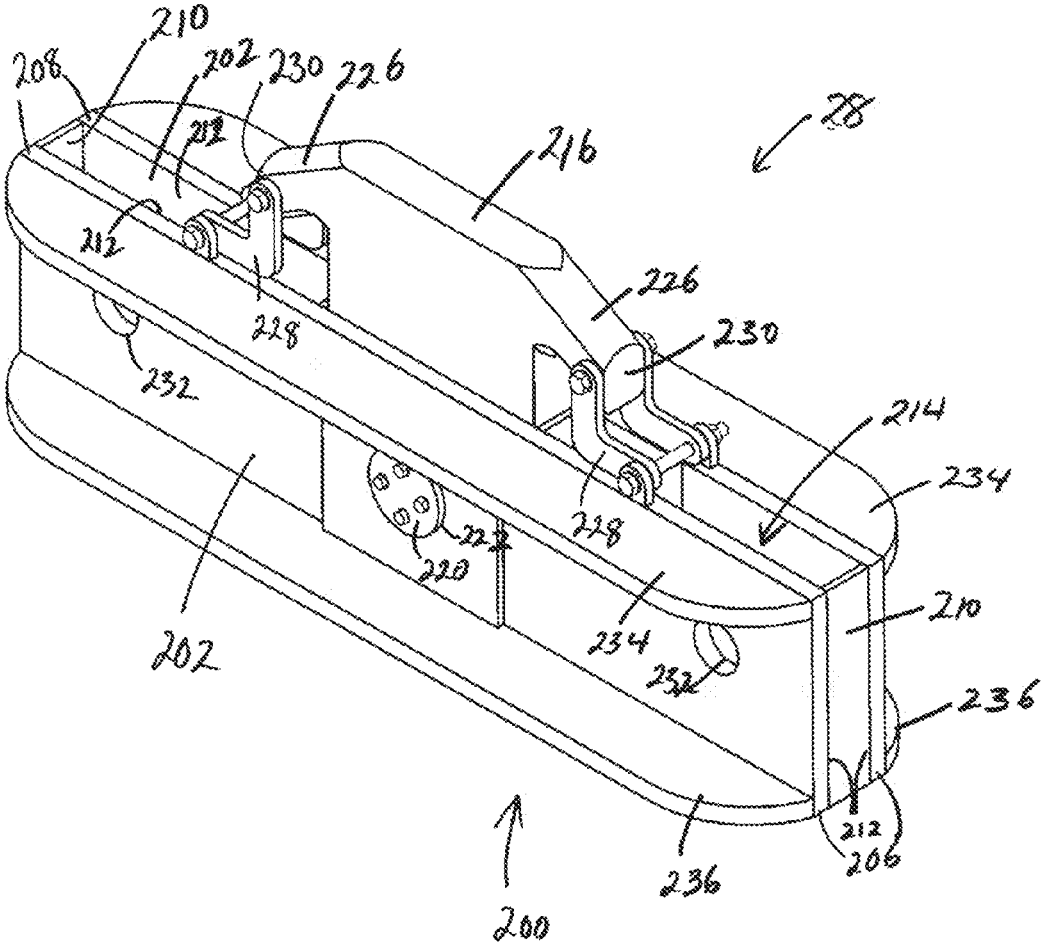
FIG. 9 is a perspective view of an upper frame section of coiled tubing lift frame assembly shown in FIGS. 1-8.

Referring now to FIG. 9, there is shown a detailed perspective view of the upper frame section 28 of coiled tubing lift frame assembly 10, 10'.

The upper frame section 28 comprises a cross member 200 in the form of a spreader beam. The cross member 200 may be a pair of parallel plates 202 spaced apart from one another. Each plate 202 has an upper edge 204, a lower edge 206, and opposing side edges 208. An end plate 210 extends between respective internal faces 212 of the parallel plates 202 at opposing side edges 208, thereby defining a cavity 214 between the pair of parallel plates 202.

The upper frame section 28 further comprises an attachment member 216 in the form of a lug. In this embodiment, the attachment member 216 upwardly extends from the upper edge 204 of the cross member 200 and is disposed substantially equidistantly from the opposing side edges 208 of the cross member 200.

In some embodiments, the attachment member 216 may be integrally formed with the parallel plates 202 of the cross member 200 or may be welded to the parallel plates 202.

However, in the particular embodiment shown in FIG. 9, the attachment member 216 has a body 218 that is inserted into the cavity 214 between the pair of parallel plates 202 and secured therebetween by fasteners 220. The fasteners 220 may take the form of a pin that is inserted through correspondingly aligned apertures 222,224 in the parallel plates 202 and the body 218 of the attachment member 216, respectively. Advantageously, this particular arrangement provides the attachment member 216 with limited rotation, helping to reduce member forces on the attachment member 216 due to unequal bail lengths and skew loading thereon.

The attachment member 216 may be configured to be coupled to the top drive system 120 by various coupling elements 30, such as bail arms or elevator links. In this embodiment, the attachment member 216 is provided with a pair of downwardly inclined ears 226 spaced from the upper edge 204 of the cross member 200. In use, as shown in FIGS. 1 and 2, respective lower ends of the bail arms 30 are engaged with the downwardly inclined ears 226 while respective upper ends of the bail arms 30 are coupled to the top drive system 120.

In one particular embodiment, maintaining engagement of the lower ends of the bail arms 30 with the downwardly inclined ears 226 may be achieved with a retainer 228 in the form of a pair of L-shaped brackets. In use, after engagement of the bail arms 30 with the downwardly inclined ears 226, the arms of the L-shaped brackets may be connected (such as with bolts, threaded screws, and so forth), respectively, to the upper edge 202 of respective parallel plates 202 and side edges 230 of the downwardly inclined ears 226. In this way, if there is a recoil event or the load decreases, the lower ends of the bail arms are prevented from disengaging the downwardly inclined ears 226 and, consequently, the upper frame section 28 is prevented from detaching from the top drive system 120.

The upper frame section 28 is also adapted to be operatively associated with the piston rods 20 of the hydraulic cylinders 12. The parallel plates 202 of the cross member 200 may be provided with a pair of apertures 232. Each aperture 232 is spaced apart from opposing side edges 208 of the cross member 200. The apertures 232 are configured, in use, to receive a pin which is inserted through a respective clevis 26 associated with the free end 24 of the piston rod 20 of the cylinder 12, thereby fixing the free end 24 of the piston rod 20 to the upper frame section 28.

The upper frame section 28 may also comprise a first pair of opposing plates 234 laterally extending from the parallel plates 202 of the cross member 200 and a second pair of opposing plates 236 laterally extending from the parallel plates 202 of the cross member 200. The first pair of opposing plates 234 is disposed adjacent to the upper edge 204 of the parallel plates 202. The second pair of opposing plates 236 is disposed adjacent to the lower edge 206 of the parallel plates 202.

Figure 10:
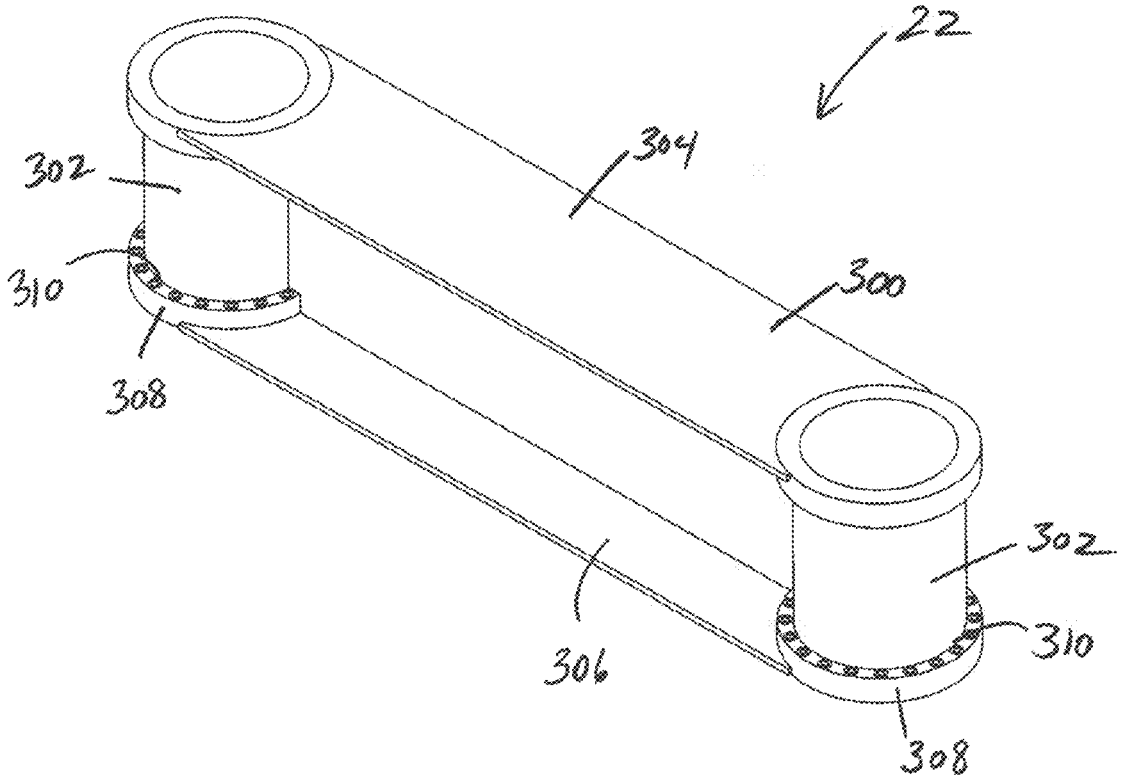
FIG. 10 is a perspective view of a cross beam section of the coiled tubing lift frame assembly shown in FIGS. 1-8.

Referring now to FIG. 10, there is shown a detailed perspective view of the cross member 22 of the coiled tubing lift frame assembly 10, 10'. In this particular embodiment, the cross member 22 takes the form of a spreader beam 300.

The cross member 22 comprises a pair of spaced apart hollow cylindrical members 302 interconnected by an upper plate 304 and a lower plate 306.

The cylindrical members 202 are each provided with a flange 308 concentrically disposed at a lower end 310 thereof. The cylindrical members 302 are spaced apart from one another such that the flanges 308 are configured, in use, to receive and couple with respective upper ends of the cylinders 12 so that the piston rods 20 of the cylinders 12 may reciprocally translate concentrically within the hollow cylindrical members 302. In this way, the intermediate member 300 provides structural rigidity to the cylinders 12.

The upper plate 304 is disposed at respective upper ends 312 of the hollow cylindrical members 302. In use, when the piston rods 20 are fully retracted, the upper plate 304 provides a landing for the upper frame section 28, as shown in FIGS. 3-8.

Figure 11:
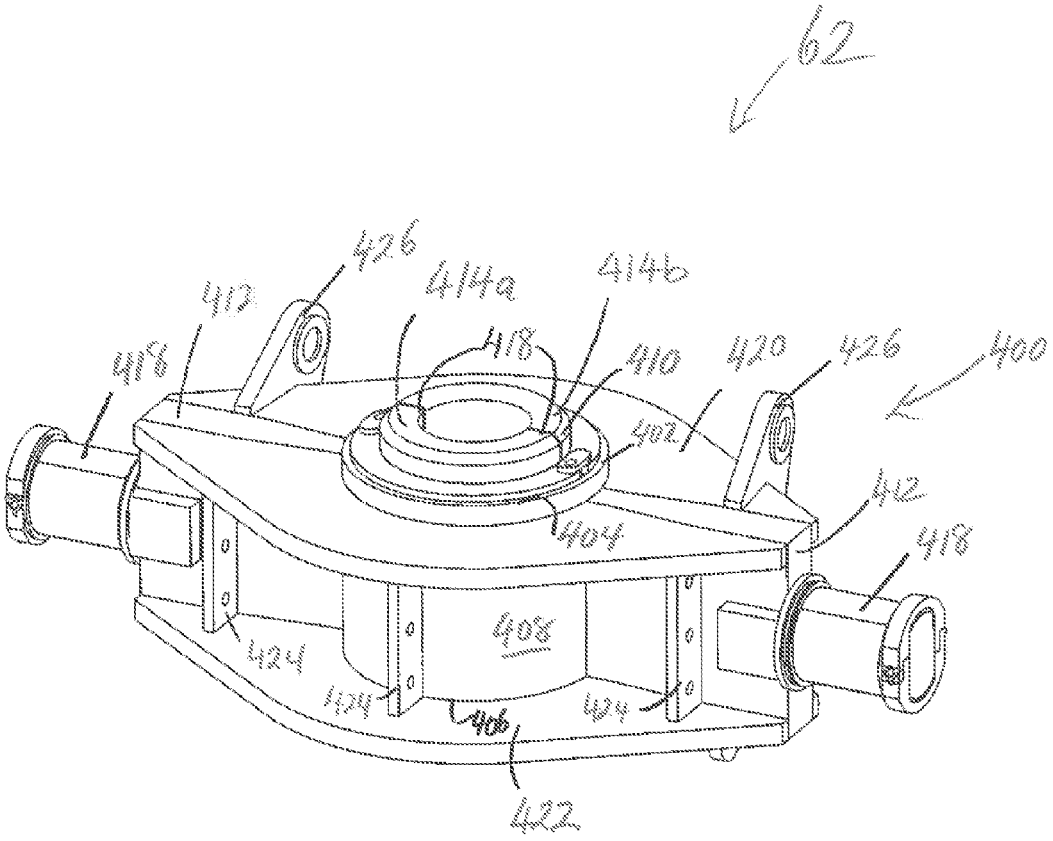
FIG. 11 is a perspective view of one embodiment of a lower frame section of the coiled tubing frame assembly shown in FIGS. 1 and 3-6.

Referring now to FIG. 11, there is shown a detailed perspective view of the lower frame section 62 of the coiled tubing lift frame assembly 10. In this particular embodiment, the lower frame section 62 is adapted for the respective lower ends 58, 60 of the piston accumulator 40 and the air accumulator 42 to be fixed thereto.

The lower frame section 62 comprises a cross member 400 in the form of a spreader beam. The cross member 400 comprises a cylindrical member 402 having an upper edge 404, a lower edge 406, an outer cylindrical wall 408, and an inner cylindrical wall 410. The lower frame section 62 also comprises a pair of opposing side plates 412 outwardly extending from respective opposing sides of the outer cylindrical wall 408. The side plates 412 may be outwardly tapering.

The lower frame section 62 further comprises a pair of split insert members 414 which are locked in place by a collar member 416. The split insert members 414 comprises a pair of semi-cylindrical members 414*a*, 414*b* which are disposed to abut each other at facing edges 518 thereof. The cylindrical members 414*a*, 414*b* are concentrically disposed to abut the inner cylindrical wall 410 of the cylindrical member 402. The pair of split inserts 414 is advantageously formed to interface with any one of a plurality of general flowhead assemblies 130. The collar member 416 is advantageously formed with a wedge type cross section, holding the split inserts 414 securely with the cylindrical member 402 in tension without the need for additional securing bolts.

In use, the flowhead assembly 130 is interfaced with the lower frame section 62 by coupling the flowhead assembly 130 with the split inserts 414 and the collar member 416 proximal to the lower edge 406 of the cylindrical member 402. In this way, the lower frame section 62 is capable of locking directly to the flowhead assembly 130.

The cross member 400 may be provided with a pair of opposing shafts 418. The shafts 418 outwardly extend from the opposing side plates 412 in longitudinal alignment therewith. In use, the shafts 418 are configured to engage the spherical bearings in the lower ends 58,60 of the piston accumulator 40 and the air accumulator 42 in a manner whereby they are directly fixed to the lower frame section 62.

The lower frame section 62 may also comprise a first pair of opposing plates 420 laterally extending from the cylindrical member 402 and the side plates 412 of the cross member 400 and a second pair of opposing plates 422 laterally extending from the cylindrical member 402 and the side plates 412 of the cross member 400. The first pair of opposing plates 420 is disposed adjacent to the upper edge 404 of the cylindrical member 402. The second pair of opposing plates 422 is disposed adjacent to the lower edge 406 of the cylindrical member 402. A plurality of substantially vertical brace members 424 may extend between the first and second pairs of plates 420, 422 to provide additional strength and rigidity to the lower frame section 62 and to provide additional handling points. The vertical brace members 424 may be equidistantly spaced with respect to one another.

The lower frame section 62 may be further provided with a pair of load bearing lugs 426 in the form of padeyes. The load bearing lugs 426 upwardly extend from the first pair of opposing plates 420. The load bearing lugs 426 may be integrally formed with substantially vertical brace members 424 extending between the first and second pairs of opposing plates 420, 422. The load bearing lugs 426 and the vertical brace members 424 are equidistantly spaced apart from opposing sides of the cross member 400. Advantageously, the load bearing lugs 426 may be used to lift the coiled tubing lift frame assembly 10.

Figure 12:
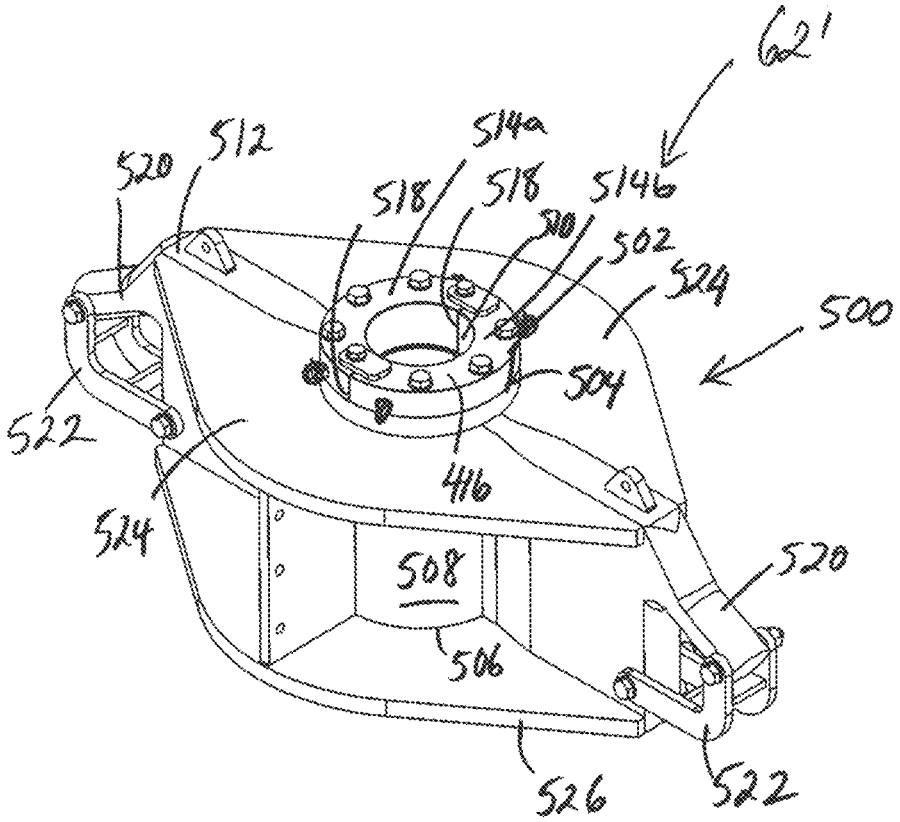
FIG. 12 is a perspective view of another embodiment of a lower frame section of the coiled tubing frame assembly shown in FIGS. 2 and 7-8.
Figure 13:
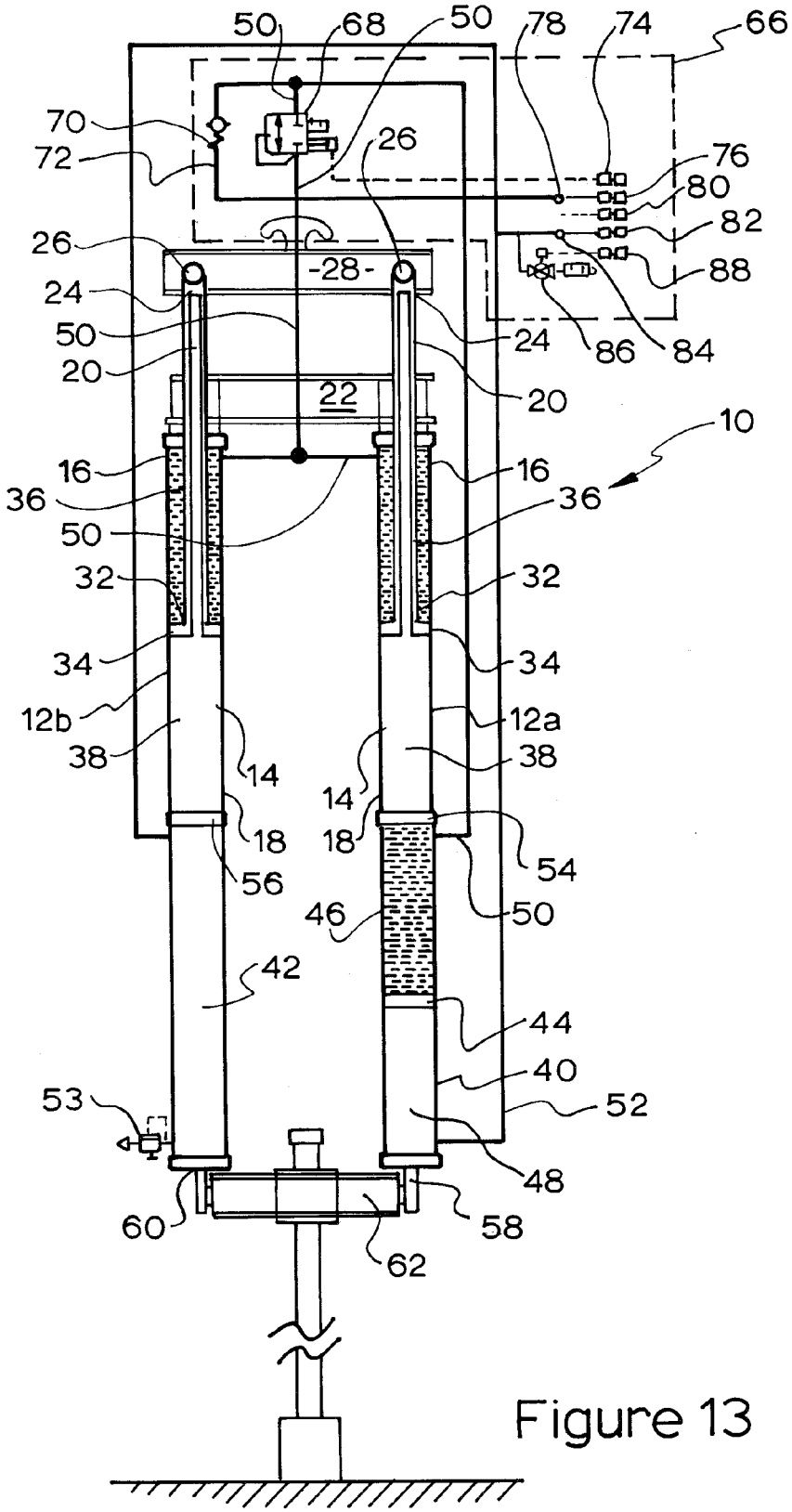
FIG. 13 is a schematic representation of the coiled tubing lift frame assembly in accordance with the embodiments shown in FIGS. 1 and 3-6 together with a schematic representation of a control valve assembly.

Referring now to FIG. 12, there is shown a detailed perspective view of the lower frame section 62' of the coiled tubing lift frame assembly 10'. In this particular embodiment, the lower frame section 62' is adapted to be connected to the cylinders 12 by means of coupling elements 64 such as long bails or elevator links.

The lower frame section 62' comprises a cross member 500 in the form of a spreader beam. The cross member 500 comprises a cylindrical member 502 having an upper edge 504, a lower edge 506, an outer cylindrical wall 508, and an inner cylindrical wall 510. The lower frame section 62' also comprises a pair of opposing side plates 512 outwardly extending from respective opposing sides of the outer cylindrical wall 508.

The lower frame section 62' further comprises a pair of split insert members 514 which are locked in place by a collar member 516. The split insert members 514 comprise a pair of semi-cylindrical members 514*a*, 514*b* which are disposed to abut each other at facing edges 518 thereof. The cylindrical members 514*a*, 514*b* are concentrically disposed to abut the inner cylindrical wall 510 of the cylindrical member 502. The pair of split inserts 514*a*, 514*b* is advantageously formed to interface with any one of a plurality of general flowhead assemblies 130. The collar member 516 is advantageously formed with a wedge type cross section, holding the split inserts 514 securely with the cylindrical member 502 in tension without the need for additional securing bolts.

In use, the flowhead assembly 130 is interfaced with the lower frame section 62' by coupling the flowhead assembly 130 with the split inserts 514 and the collar member 516 proximal to the lower edge 506 of the cylindrical member 502. In this way, the lower section 62' is capable of locking directly to the flowhead assembly 130.

The lower frame section 62' may be also adapted to engage the cylinders 12. The cross member 500 may be provided with a pair of downwardly depending ears 520. The downwardly depending ears 520 outwardly extend from the opposing side plates 512 in longitudinal alignment therewith. In use, as shown in FIG. 2, respective lower ends of the bail arms 64 are engaged with the downwardly inclined ears 520 while respective upper ends of the bail arms 64 are coupled to the lower ends 18 of the cylinder barrels 12.

In one particular embodiment, maintaining engagement of the lower ends of the bail arms 64 with the downwardly inclined ears 520 may be achieved with a retainer 522 in the form of a pair of L-shaped brackets. In use, after engagement of the bail arms 64 with the downwardly inclined ears 520, the arms of the L-shaped brackets 522 may be connected (such as with bolts, threaded screws, and so forth), respectively, to the opposing side plates 512 and the downwardly inclined ears 520.

The lower frame section 62' may also comprise a first pair of opposing plates 524 laterally extending from the cylindrical member 502 and the side plates 512 of the cross member 500 and a second pair of opposing plates 526 laterally extending from the cylindrical member 502 and the side plates 512 of the cross member 500. The first pair of opposing plates 524 is disposed adjacent to the upper edge 504 of the cylindrical member 502. The second pair of opposing plates 526 is disposed adjacent to the lower edge 506 of the cylindrical member 502.

The coiled tubing lift frame assembly 10, 10' may further comprise a control valve assembly 66 arranged to control fluid flow through the hydraulic fluid line 50 and thereby either hydraulically lock the piston rods 20 locking them stationary at any position in the stroke, typically mid-stroke, or allow the piston rods 20 to retract or extend in response to, and to compensate for, heave of the floating vessel. The control valve assembly 66 may be housed in a control manifold 67.

The control valve assembly 66 may comprise an overpressure valve 68 in the hydraulic line 50 and an under pressure valve 70 to redirect fluid flow through a bypass line 72 configured to bypass the over pressure valve 68. The overpressure valve 68 and the under pressure valve 70 are configured to remain closed when the axial load on the riser 110 is within the predetermined range of operating loads, thereby causing the piston rods 20 in said cylinders 12 to remain stationary at a mid-stroke position.

The over pressure valve 68 is arranged to automatically and rapidly open at a predetermined pressure. It latches open once activated to provide fluid communication between the cylinders 12 and the piston accumulator 40 for back-up heave compensation. It is remotely resettable from a drill floor control panel via a pilot line and may also be configured to be capable of being remotely manually opened and closed via a separate pilot line 74.

The control valve assembly 66 also includes the pilot line 74 to manually open and close the overpressure valve 68; a fluid fill and drain line 76; a pilot operated check valve 78 for fluid fill and drain, preferably self-sealing; a pilot line 80 to open the check valve 78 for fluid drain; an air fill line 82; a check valve 84 for the air fill line 82, preferably self-sealing; an actuated ball valve 86 for an air vent; and a pilot line 88 to operate the ball valve 86.

In use, the coiled tubing lift frame assembly 10, 10' may be employed as a back-up compensator for a primary compensator in the form of a drill string compensator. The coiled tubing lift frame assembly 10, 10' may be installed by first retracting the piston rods 20 of the cylinders 12. The upper frame section 28 may then be coupled to the top drive system 120 by various couplers, such as short bails or elevator links 30. The flowhead assembly 130 may then be interfaced with the lower frame section 26, 26' by coupling the flowhead assembly 130 with the split inserts and the collar member proximal to the lower edge of the spreader cross beam. The over pressure valve may then be manually opened to allow the piston rods 20 to stroke to a mid-stroke position. Under normal operating load conditions, the piston rods 20 remain stationary at the mid-stroke position.

In the event of the rig's drill string compensator failing, on an up heave of the floating vessel the axial load on the riser may exceed an upper predetermined operating threshold load. In these circumstances, the over pressure valve 68 will automatically open and latch open, allowing hydraulic fluid to flow through the hydraulic line 50 to provide fluid communication between the cylinders 12 and the piston accumulator 40 and allow the piston rods 22 in the cylinders 12 to extend in response to, and to compensate for, heave of the vessel.

Alternatively, on a down heave of the floating vessel the axial load on the riser may fall below a lower predetermined operating threshold load. The under pressure valve 70 will automatically open, allowing hydraulic fluid to flow through the hydraulic line 50 and the bypass flow path 72 to provide fluid communication between the cylinders 12 and the piston accumulator 40 and allow the piston rods in the cylinders 12 to retract in response to, and to compensate for, heave of the vessel. At the heave trough, the under pressure valve 70 will automatically reset, and the over pressure valve 68 will then actuate on the subsequent up heave of the floating vessel as described above, and the latch open providing a primary flow path between the cylinders 12 and accumulator 40 for ongoing back-up compensation.

Numerous variations and modifications will suggest themselves to persons skilled in the relevant art, in addition to those already described, without departing from the disclosure. All such variations and modifications are to be considered within the scope of the disclosure.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A coiled tubing lift frame assembly comprising:

a frame having an upper frame section adapted for attachment to a top drive system and a lower frame section adapted to interface with a flowhead assembly;

a pair of hydraulic cylinders spaced apart from one another, the hydraulic cylinders having a respective cylinder barrel and a piston rod translatable therein, a free end of the piston rods being fixed to the upper frame section;

a single piston accumulator, the single piston accumulator disposed adjacent to a first of the hydraulic cylinders and in fluid communication therewith via a hydraulic fluid line;

an air accumulator disposed adjacent to a second of the hydraulic cylinders and in fluid communication with the piston accumulator via a pneumatic fluid line;

wherein the single piston accumulator and the air accumulator are both supported by the upper frame and section and wherein the piston rods in the cylinders remain stationary at a mid-stroke position when an axial load on the riser is within a predetermined range of operating loads, the piston rods extending on an upheave of the floating vessel when the axial load exceeds a predetermined upper operating load threshold and retracting on a down heave of the floating vessel when the axial load falls below a predetermined lower operating load threshold.

2. The assembly as defined in claim 1, wherein the air accumulator and the piston accumulator are respectively longitudinally aligned with the first and the second of the hydraulic cylinders.

3. The assembly as defined in claim 2, wherein respective lower ends of the air accumulator and the piston accumulators are fixed to the lower frame section.

4. The assembly as defined in claim 1, wherein the air accumulator and the piston accumulator are respectively laterally aligned with the first and the second of the hydraulic cylinders.

5. The assembly as defined in claim 4, wherein respective lower ends of the hydraulic cylinders are coupled to the lower frame section with coupling elements.

6. The assembly as defined in claim 1, wherein the upper frame section is attached to the top drive system by means of further coupling elements.

7. The assembly as defined in claim 1, wherein the hydraulic cylinders are arranged to be in fluid communication with one another via the hydraulic line, whereby the hydraulic pressure in each cylinder is the same.

8. The assembly as defined in claim 1, further comprising a control valve assembly arranged to control fluid flow through the hydraulic fluid line and thereby either hydraulically lock the piston rods, or allow the piston rods to retract or extend in response to, and to compensate for, heave of the floating vessel.

9. The assembly as defined in claim 8, wherein the piston rods are locked at mid-stroke when the assembly is operated in a back-up mode.

10. The assembly as defined in claim 9, wherein the control valve assembly comprises an overpressure valve in the hydraulic line and an under pressure valve to redirect fluid flow through a bypass line configured to bypass the over pressure valve.

11. The assembly as defined in claim 10, wherein the overpressure valve and the under pressure valve are configured to remain closed when the axial load on the riser is within the predetermined range of operating loads, thereby causing the piston rods in the cylinders to remain stationary at a mid-stroke position.

12. The assembly as defined in claim 10, wherein when the axial load exceeds a predetermined upper operating load threshold, the overpressure valve opens to allow hydraulic fluid to flow through the hydraulic line between the cylinders and the piston accumulator, thereby allowing the piston rods in the cylinders to extend.

13. The assembly as defined in claim 12, wherein the overpressure valve latches open to provide ongoing back-up compensation after actuating.

14. The assembly as defined in claim 12, wherein the over pressure valve can be remotely reset.

15. The assembly as defined in claim 10, wherein when the axial load falls below a predetermined lower operating threshold, the under pressure valve opens to redirect hydraulic fluid through the bypass line and flow between the cylinders and the piston accumulator, thereby allowing the piston rods in the cylinders to retract.

16. The assembly as defined in claim 1, wherein the piston accumulator comprises a cylinder barrel having a hydraulic chamber and a pneumatic chamber defined therein, wherein the pneumatic chamber is in communication with the accumulator via the pneumatic fluid line and the hydraulic chamber is in communication with the first of the cylinders via the hydraulic fluid line.

17. The assembly as defined in claim 1, wherein the piston rod is hollow and in fluid communication with a respective blind side of the cylinder via an aperture in the piston head.

18. A method for providing back up compensation for a riser used in operations on a floating vessel in the event of failure of a primary compensator comprising:

providing the coiled tubing lift frame assembly as defined in claim 10;

locating the frame between the top drive system and the flow head assembly in a manner whereby the upper frame section of the frame is coupled to the top drive system and the lower frame section of the frame is coupled to the flow head assembly;

disposing the piston rods in the hydraulic cylinders in a back-up mode whereby the piston rods remain stationary at a mid-stroke position when an axial load on the risers is within a predetermined range of operating loads; and, in the event of failure of the primary compensator and the axial load on the riser exceeding a predetermined upper operating load threshold or falling below a predetermined lower operating load threshold, allowing the piston rods to extend or retract from the mid-stroke position, respectively.

19. The method as defined in claim 18, wherein in the event of failure of the primary compensator and the axial load on the riser exceeding a predetermined upper operating load threshold or falling below a predetermined lower operating load threshold, the method further comprises automatically actuating the over pressure valve or under pressure valve of the control valve assembly, respectively.

20. The method as defined in claim 19, wherein in the event of actuation of the over pressure valve, the overpressure valve latches open and provides an unrestricted flow path between the cylinders and the piston accumulator allowing the system to provide back-up compensation.

21. The method as defined in claim 20, wherein back-up compensation comprises a passive compensator.

22. The method as defined in claim 18, wherein the method may comprise manually opening the over pressure valve to purposefully actuate the coiled tubing lift frame assembly to provide passive heave compensation.

* * * * *